US008102360B2

(12) United States Patent
Chan et al.

(10) Patent No.: US 8,102,360 B2
(45) Date of Patent: Jan. 24, 2012

(54) METHODS AND APPARATUS OF DYNAMIC BACKLIGHT CONTROL

(75) Inventors: Wing Chi Stephen Chan, Kowloon (HK); Wai Pak Icarus Choi, Tai Po Lam Tsuen (HK); Wai-Yan Stephen Lai, Kowloon (HK)

(73) Assignee: Solomon Systech Limited, New Territories (HK)

( * ) Notice: Subject to any disclaimer, the term of this patent is extended or adjusted under 35 U.S.C. 154(b) by 931 days.

(21) Appl. No.: 12/116,739

(22) Filed: May 7, 2008

(65) Prior Publication Data

US 2009/0278786 A1 Nov. 12, 2009

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,717,422 | A | 2/1998 | Fergason | |
| 7,176,878 | B2 | 2/2007 | Lew | |
| 2006/0274026 | A1 * | 12/2006 | Kerofsky | 345/102 |

* cited by examiner

*Primary Examiner* — Richard Hjerpe
*Assistant Examiner* — Towfiq Elahi
(74) *Attorney, Agent, or Firm* — Ella Cheong Hong Kong; Margaret A. Burke; Sam T. Yip

(57) ABSTRACT

A method of adjusting image intensity to compensate backlight dimming in dynamic backlight control, the method including estimating distortion of an image that corresponds to different mapping index values 204 selected from the intensity levels 202 of an image. The estimated distortion of image represents factors including the quantity of pixels 205 that have intensity exceeding a mapping index value 204; and the amount 206 that the intensity of each pixel exceeds the corresponding mapping index value. The method further includes selecting from a plurality of schemes 301 for adjusting image intensity to minimize the estimated distortion obtained from the estimating.

5 Claims, 5 Drawing Sheets

METHODS AND APPARATUS OF DYNAMIC BACKLIGHT CONTROL

TECHNICAL FIELD

This presently claimed invention relates generally to methods and apparatuses of saving power consumption in a display system; and more particularly, methods and apparatuses of dynamically controlling the backlight of a display system according to a displayed image to reduce power consumption.

BACKGROUND

Liquid crystal display (LCD) screens are commonly backlighted to make them easier to read. Known liquid crystal displays (LCD) with backlighting commonly include a core of LCD material between sheets of glass. A backlighting element produces light to illuminate LCD material is disposed at the back of the glasses. From a power consumption point of view, LCD backlighting is far from efficient. For example, while the backlighting element is set to a bright level to illuminate the LCD material, depending on the image values to be displayed in pixels, the LCD material may be in a twisting configuration which causes a substantial portion of light passing through the LCD material to be blocked by the second polarizer, resulting in inefficient use of backlighting. In fact, power consumption of LCD backlight may account for a large portion of the overall power consumption of a display device. The energy inefficiency due to LCD backlighting may lead to a series of power problems, including, shorter operating time than the capacity of a battery could have provided, frequent charging and discharging of the battery and hence reduced battery life, which may be particularly problematic for displays in portable devices, e.g., mobile phone. Backlight control is therefore an important feature for display systems.

SUMMARY

This presently claimed invention relates to methods and apparatuses that choose the dimming factor of the backlight and the boosting factor of the display pixels for an image. Estimation on distortion of image quality is made based on the aggregated weighted error due to pixel value boosting for backlight dimming compensation.

Table 1 below lists out the notation of variables being used for describing the presently claimed invention throughout the specification.

TABLE 1

| | |
|---|---|
| Dimming Factor, or Backlight Scale Factor | D |
| Boosting Factor, or Pixel Value Scale Factor | B |
| Gamma of LCD | $\gamma$ |
| Pixel Value In | $PV_{IN}$ |
| Pixel Value Out | $PV_{OUT}$ |
| Clipping value (for prior arts) or mapping index value (for this invention) | $X_C$ |
| Number of Intensity Levels | N |
| Minimum value safeguard limit for $X_C$ | M |
| Pixel Value Distribution Function | F(i) |
| Compromised Quality | $Q_C$ |
| Maximum Compromised Quality | $Q_{C_MAX}$ |

Reduction of power consumption of a LCD backlight can be brought about by reducing the amount of backlighting (or dimming the backlighting).

Intensity adjustment for high contrast passive display can be performed by adjusting the backlight of a display system dynamically according to the displayed image to alter the brightness of the image substantially without affecting the contrast ratio. This method of control backlighting is designed from a display performance point of view, for achieving a high display contrast ratio. It does not however tackle the problem of power efficiency for backlighting.

Backlight dimming and LCD amplitude boost can also be performed by dynamic backlight control (DBC) that avoids truncating the maximum value and includes the steps of: dimming backlighting of the display; increasing values of pixels to be displayed on the display to compensate for the dimming; and clamping the pixel values to a maximum threshold, wherein the maximum threshold is expressed as a digital value and is limited to a value which avoids truncating the maximum value. The "clamping step" refers to comparing pixel values with a maximum threshold and limiting the boosted pixel values to a maximum threshold when they are larger than such maximum threshold. This operation, however, leads to loss of details in part of a displayed image.

There is a trade-off between power consumption and the display quality. A proper selection of the backlight dimming factor (D) and a pixel value boosting factor (B) will achieve a required power saving ratio while degrading the display quality as little as possible. For the simplest case, one can assume B equals the inverse of D. Normally, B can only be greater than or equal to one. When the pixel values are boosted by the boosting factor (B), some of the pixel values may exceed the maximum value that the display is capable to exhibit. For example, assuming 255 is the maximum value for an 8-bit display data, the pixel values after boosting would be clamped to the maximum value of 255. This is referred as clipping and the point where clipping starts to happen is regarded as the clipping point or clipping value, $X_C$.

Backlight dimming factor (D) and a pixel value boosting factor (B) can be determined according to preset threshold levels of the clamping loss. If clamping loss exceeds the high threshold, the boosting factor of pixels is decreased and the dimming factor of backlight is increased (dimming less), and if clamping loss falls below the low threshold, the boosting factor of pixels is increased (dimming more) and the dimming factor of backlight is decreased. The factors may be calculated based on an average pixel value of one or more frames of pixels values or from a maximum pixel value of one or more frames of pixels values. This method however may lead to an over-estimated dimming factor for images that dims the backlight too low and results too much clamping loss of image in highlight.

However, without adjusting pixel values to compensate for dimming the backlighting, the overall brightness of the LCD as perceived by a user may be undesirably reduced. Therefore, pixel values are boosted up to maintain an overall perceptible image quality of the display. The above process is called dynamic backlight control (DBC). The fundamental process of DBC includes the three below steps:

(1) determining a backlight dimming factor (D) and, a pixel value boosting factor (B), (2) dimming the backlight by the dimming factor (D), and (3) boosting the pixel values by the boosting factor (B) to compensate for the backlight dimming.

The boosting of pixel values, however, can lead to overflow of pixel values that exceed the maximum brightness limit of a display panel.

Accordingly, several aspects of the claimed invention have been developed with a view to substantially reduce or eliminate the drawbacks described hereinbefore and known to those skilled in the art and to provide a method of adjusting image intensity to compensate backlight dimming using dynamic backlight control. In certain embodiments, the method includes estimating distortion of an image that corresponds to different mapping index values selected from the intensity levels of the image. The estimated distortion of an image represents factors including the quantity of pixels that have intensity exceeding said mapping index value; and the amount that the intensity of each said pixel exceeds the corresponding mapping index value. The method further includes selecting from a plurality of schemes for adjusting image intensity to minimize the estimated distortion obtained from the estimating.

Advantageously, the step of selecting schemes further includes the step of determining an optimum mapping index value that corresponds to the minimum estimated distortion of image.

The step of selecting schemes preferably further contains the step of choosing an optimum mapping curve from a set of mapping curves corresponding to different mapping index values. The optimum mapping curve may correspond to the optimum mapping index value for converting the intensity of each pixel in the image. In one exemplary embodiment, such set of mapping curves when plotted on a Cartesian plane, with input pixel intensity as X-axis and output pixel intensity as Y-axis, has an initial slope of N/XC, where N is the number of intensity levels for the image and Xc is the corresponding mapping index value. The mapping curves may be linear curves or non-linear curves.

According to one embodiment, the step of estimating distortion of image includes the step of computing the expression $$\sum_{i=Xc}^{N}(i-X_c)^{\gamma}F(i),$$

where γ is the gamma factor of a display for displaying the image; F(i) is the pixel value distribution function of the image to be displayed; N is the number of intensity levels; and $X_C$ is the mapping index value.

According to another embodiment, the step of estimating distortion of image includes the step of calculating the expression $$\left(\frac{N}{X_c}\right)^{\gamma}\cdot\sum_{i=Xc}^{N}(i-X_c)^{\gamma}F(i),$$

where γ is the gamma factor of a display for displaying the image; F(i) is the pixel value distribution function of the image to be displayed; N is the number of intensity levels; and $X_C$ is the mapping index value.

According to an exemplary embodiment, the method of adjusting backlight and image pixel intensity includes the operation steps below:

(1) For an image to be displayed, determine of the minimum clipping point according to a given maximum Compromised Quality (2) Map the original pixels values to a new set of values using the minimum clipping point, as an index of mapping, (3) Dim the backlight with a dimming factor determined by the minimum clipping point, and (4) Display the image on the display panel with the new set of pixel values.

According to another aspect of the present invention, there is provided an apparatus for adjusting image intensity to compensate backlight dimming in dynamic backlight control. The apparatus includes a processing unit for estimating distortion of an image that corresponds to different mapping index values, where $X_C$ is selected from the intensity levels of the image. The estimated distortion of image represents factors includes the quantity of pixels that have intensity exceeding said mapping index value; and the amount that the intensity of each said pixel exceeds the corresponding mapping index value. The apparatus further includes a look up table for selecting from a plurality of schemes for adjusting image intensity to minimize the distortion estimated by said processing unit.

Advantageously, the processing unit further comprises a first accumulator configured to calculate $$\sum_{i=x}^{N}F(i);$$

and a second accumulator configured to calculate $$\sum_{i=x+1}^{N}(i-x)\cdot F(i).$$

Other aspects of the invention are also hereby disclosed.

BRIEF DESCRIPTION OF THE DRAWINGS

Embodiments of the invention are described in more detail hereinafter with reference to the drawings, in which.

DETAILED DESCRIPTION

Improved methods and apparatuses for dynamic backlighting are disclosed herein. In the following description, numerous specific details, including circuit components, parameters, pixel intensity, and the like are set forth. However, from this disclosure, it will be apparent to those skilled in the art that modifications, including additions and/or substitutions may be made without departing from the scope and spirit of the invention. In other circumstances, specific details may be omitted so as not to obscure the invention. Nonetheless, the disclosure is written as to enable one skilled in the art to practice the teachings of the embodiments of the invention without undo experimentation.

Figure 1:
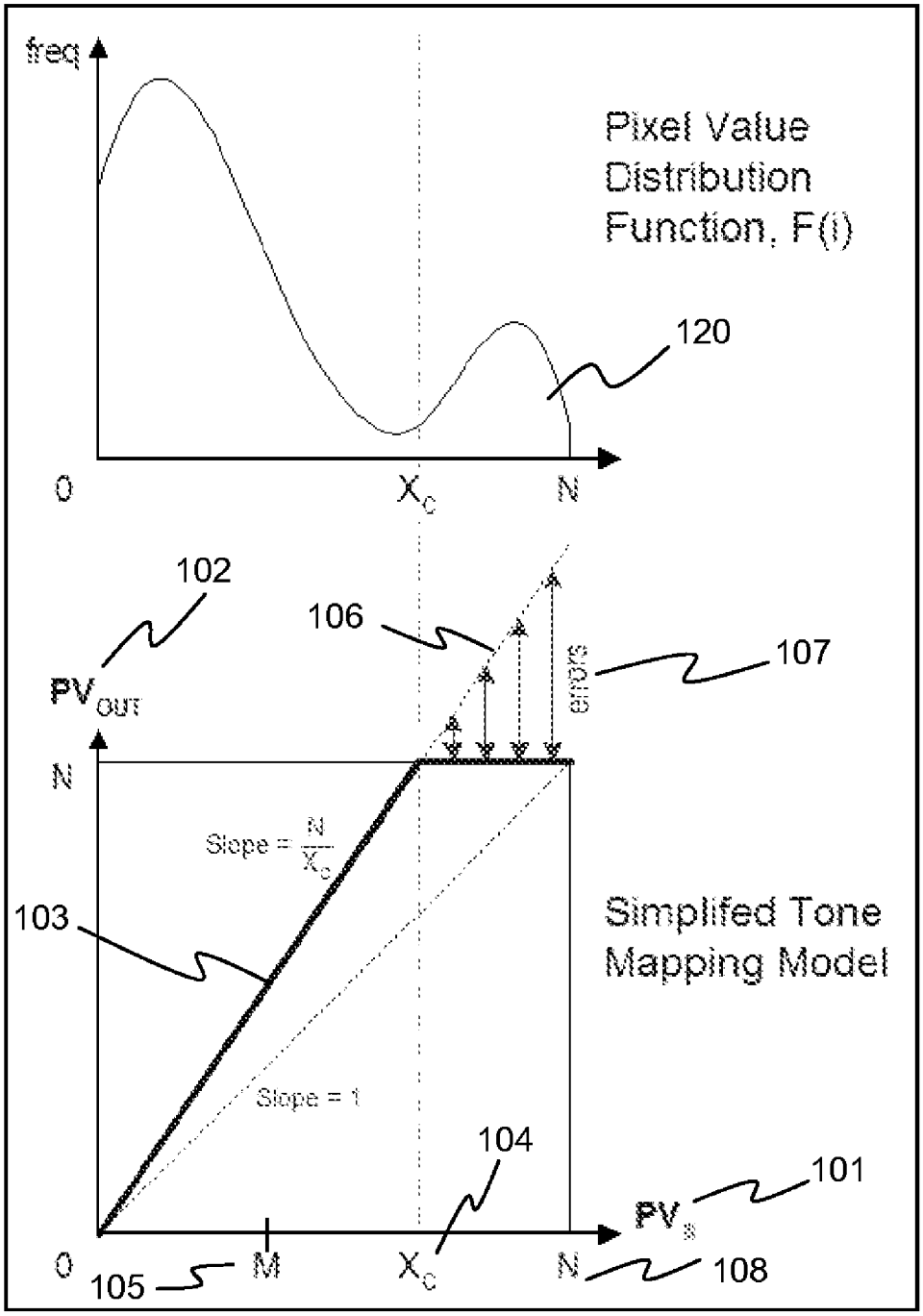
FIG. 1 illustrates a tone mapping model according to an embodiment of the presently claimed invention.

FIG. 1 shows a simplified tone mapping model according to an embodiment of the invention. FIG. 1 depicts how the input pixel value 101, $PV_{IN}$, is mapped to the output pixel value 102, $PV_{OUT}$ through a piecewise linear curve 103. The diagram also shows the clipping point 104, $X_C$, where the corresponding output pixel value 102 reaches the maximum value 108, N. The slope of the first part of the piecewise linear curve, $N/X_C$, is equal to the boosting factor, B. For a special case where the slope equals one, the input pixel values will always equal the output pixel values such that no boosting has been performed. Minimum point 105, M indicates the minimum value that $X_C$ can be. In other words, the slope or boosting factor is bounded by, $$\frac{N}{M} \geq B \geq \frac{N}{N}$$

When the slope is being extrapolated with a straight line 106, the error due to clipping becomes visible. This error portion 107 together with the Pixel Value Distribution Function, F(i) are used to determine the distortion of image quality, regarded as the Compromised Quality, $Q_C$.

FIG. 1 also shows the Pixel Value Distribution Function, F(i) 120 above the Simplified Tone Mapping Model 110. F(i) 120 is obtained by scanning one complete image frame. All pixel values of the image are accumulated into an array of counters to form a histogram or distribution function. According to an embodiment of the invention for dynamic backlight control, F(i) is updated at the frame rate.

The dimming factor D and the boosting factor B are typically adjusted, within a predetermined operating range, according to the image to be displayed in an attempt to limit the clamping loss. For a DBC system requiring an aggressive power saving, a high threshold level of the clamping loss is set; for a DBC system requiring less image clamping, a low threshold level is set. To avoid application issues in extreme dimming of backlight, such as probable difficulties in accurate control of the dimming to very low level and corresponding computational complexity of scaling data by a large multiplier, a minimum value safeguard limit for $X_C$ can be set at M according to specific application need.

According to an embodiment of the presently claimed invention, the backlight is adjusted to achieve lower power consumption. The brightness level of backlight is reduced substantially while limiting undesirable visual effects to displayed images as low as possible or below a perception threshold level.

Determining of the Minimum Clipping Point

Figure 2:
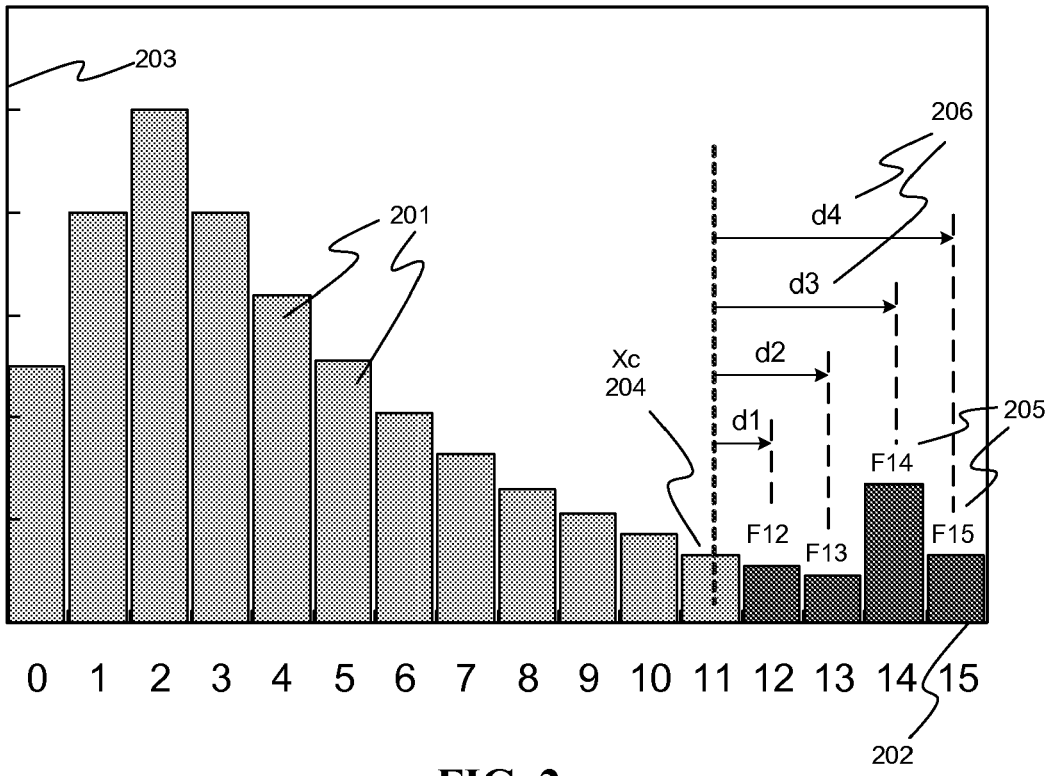
FIG. 2 illustrates an exemplary pixel value distribution of an image.

For illustration of the present invention, FIG. 2 shows an exemplary distribution of pixel value among an image. The distribution of each intensity level is indicated by bars 201. The x-axis 202 corresponds to the level of intensity (or pixel value) whereas the y-axis 203 relates to the number of pixels having a certain intensity value.

The calculation of the Compromised Quality according to an embodiment of the presently claimed invention is illustrated below for this exemplary pixel value distribution.

According to one embodiment of the invention, Compromised Quality, $Q_C$, is defined as the aggregated weighted error due to pixel value boosting for backlight dimming compensation. The weighting is the pixel value distribution 205 and the error 206 is multiplied by the slope factor of $N/X_C$ as based on the Simplified Tone Mapping Model depicted in FIG. 1. For example, if the clipping point $X_C$ 204 has a value of 11, the distortion 206 on pixels having value equal to 12 will be d1, i.e.: 12−11=1; and the weighting of the distortion will be F12.

In the example, for $X_C$=11, $$Q_C=[F(12)*(12-11)+F(13)*(13-11)+F(14)*(14-11)+F(15)*(15-11)]*15/11$$

For $X_C$=12, $$Q_C=[F(13)*(13-12)+F(14)*(14-12)+F(15)*(15-12)]*15/12$$

The Compromised Quality for other $X_C$ are calculated in a similar manner.

Next, an optimum Compromised Quality $Q_{C_MAX}$ is chosen following the requirements of the application. Accordingly, the minimum value of $X_C$ that results in a value for the Compromised Quality closest to but not exceeding the chosen value of $Q_{C_MAX}$ is determined as the mapping index.

Generalizing the expression for $Q_C$, $$\begin{aligned} Q_C &= \sum_{i=X_C+1}^{N} \text{Error}(i)\cdot F(i) \\ &= \sum_{i=X_C+1}^{N} \text{Slope}\cdot(\text{distance from } X_c)\cdot F(i) \\ &= \sum_{i=X_C+1}^{N} \left(\frac{N}{X_C}\right)\cdot(i-X_C)\cdot F(i) \end{aligned}$$

Rearranging the above, we obtain:

$$\left(\frac{X_C}{N}\right)\cdot Q_C = \sum_{i=X_C+1}^{N} (i-X_C)\cdot F(i) \qquad \text{Equation (1)}$$

The minimum $X_C$ is then determined as the mapping index for a given $Q_{C_MAX}$ that satisfy, $$\left(\frac{X_C}{N}\right)\cdot Q_{C_MAX} \geq \sum_{i=X_C+1}^{N} (i-X_C)\cdot F(i) \qquad \text{Equation (2)}$$

In another embodiment of the invention, Compromised Quality, $Q_C$, can be defined as the aggregated weighted distance under pixel value boosting. The weighting is the pixel value distribution and the distance is that between the current pixel and the clipping value.

In the example, for $X_C$=11, $$Q_C=[F(12)*(12-11)+F(13)*(13-11)+F(14)*(14-11)+F(15)*(15-11)]$$

For $X_C$=12, $$Q_C=[F(13)*(13-12)+F(14)*(14-12)+F(15)*(15-12)]$$

The Compromised Quality for other $X_C$ are calculated in a similar manner.

An optimum Compromised Quality, $Q_{C_MAX}$ is chosen following the requirements of the application. Based on this, the minimum value of $X_C$ that results in a value for the Compromised Quality closest to but not exceeding the chosen value of $Q_{C_MAX}$ is determined as the mapping index.

Generalizing the expression for $Q_C$, $$Q_C = \sum_{i=X_C+1}^{N} (\text{distance from } X_C) \cdot F(i)$$

$$= \sum_{i=X_C+1}^{N} (i - X_C) \cdot F(i)$$

Rearranging the above, we obtain:

$$Q_C = \sum_{i=X_C+1}^{N} (i - X_C) \cdot F(i) \qquad \text{Equation (3)}$$

The minimum $X_C$ is then determined as the mapping index for a given $Q_{C_MAX}$ that satisfy, $$Q_{C_MAX} \geq \sum_{i=X_C+1}^{N} (i - X_C) \cdot F(i) \qquad \text{Equation (4)}$$

Mapping of Pixels Values

According to an embodiment of the invention, a curve mapping approach is used to boost pixels values while minimizing the loss of image details. A series of mapping curves corresponding to different clipping pixel values $X_C$ as mapping indexes are pre-stored, and each mapping curve has an initial slope of $N/X_C$. All of the mapping curves are preferably shaped to avoid clamping of pixel values near the maximum pixel value or the worst case of clamping pixel values starting at $X_C$.

The mapping index value is determined by considering the weighted error product terms, or the weighted distance product terms as described above. The index is then used to select a corresponding mapping curve from the series of mapping curves.

Figure 3:
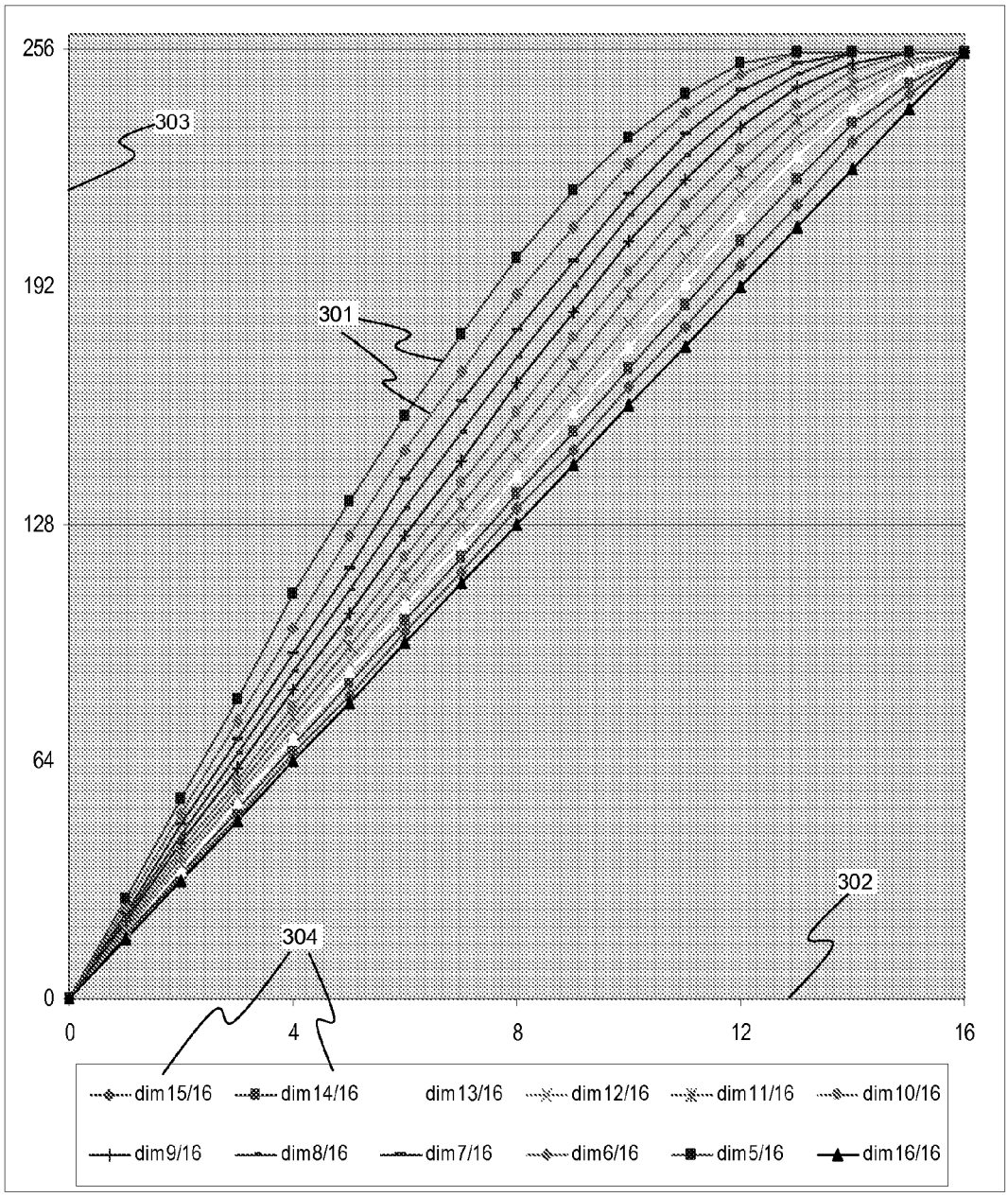
FIG. 3 illustrates the mapping curves for various dimming factors according to an embodiment of the presently claimed invention.

In one embodiment of the invention, the dimming factor of the backlighting is determined by the mapping index or equal to Xc/N. FIG. 3 shows the mapping curves 301 for different dimming factors 304 according to an embodiment of the invention. The x-axis 302 is the input pixel intensity level while the y-axis 303 is the output pixel intensity level. Each mapping curve 301 has a respective initial slope of $N/X_C$, where N is the maximum output pixel intensity level and $X_C$ is the corresponding mapping index value.

Figure 5:
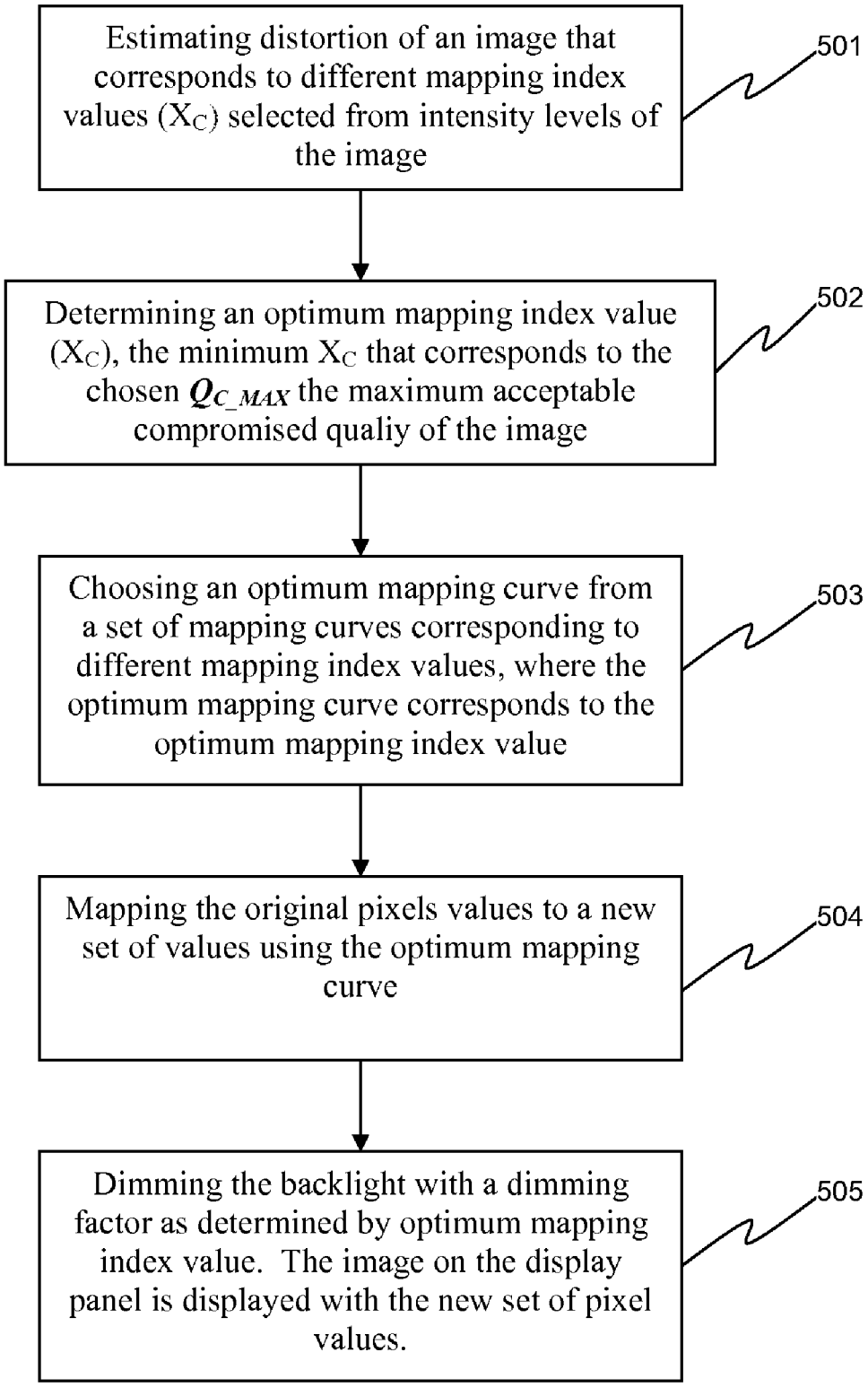
FIG. 5 is a flow chart for adjusting image intensity to compensate backlight dimming in dynamic backlight control according to an embodiment of the presently claimed invention.

FIG. 5 is a flow chart for adjusting image intensity to compensate backlight dimming in dynamic backlight control according to an embodiment of the presently claimed invention. At estimating step 501, the distortion of an image that corresponds to different mapping index values selected from the intensity levels of the image is estimated. The estimated distortion of an image represents factors including the quantity of pixels that have intensity exceeding said mapping index value, and the amount that the intensity of each said pixel exceeds the corresponding mapping index value; in another embodiment of the presently claimed invention, the estimated distortion of an image includes a third factor of N/Xc as discussed above.

At determining step 502, an optimum mapping index value that corresponds to the maximum acceptable distortion of the image is determined. In one embodiment, the optimum mapping index value, also regarded as the minimum clipping point, corresponds to the clipping point that results in a Compromised Quality value closest to but not exceeding the Maximum Compromised Quality, the chosen maximum acceptable limit of total distortion of the image.

At choosing step 503, an optimum mapping curve is chosen from a set of mapping curves corresponding to different mapping index values. In one embodiment, the optimum mapping curve corresponds to the optimum mapping index value for converting the intensity of each pixel in the image.

At mapping step 504, the original pixels values are mapped to a new set of values using the optimum mapping curve.

At dimming step 505, the backlight is dimmed with a dimming factor determined by the optimum mapping index value. The image on the display panel is displayed with the new set of pixel values.

Hardware Implementation

To solve the above inequality and determine the mapping index by hardware implementation, the left hand side of equation (2) or (4) is implemented with QC_LUT($X_C$) and the right hand side is implemented with ACC__2ND[$X_C$], the inequalities then becomes:

$$\text{QC_LUT}(x_C) \geqq \text{ACC__2ND}[x_C] \qquad \text{Equation (5)}$$

QC_LUT are the values of optimum Compromised Quality stored in a Look-Up-Table (LUT). For one embodiment described before, the factor of N/Xc can be included into the values of QC_LUT for implementation convenience. The LUT can be implemented by combinational logic, memory units such as Read Only Memory (ROM), or Programmable Logic Device (PLD) such as Programmable Array Logic (PAL) and Field Programmable Gate Array (FPGA). For the right hand side of equation (5), the hardware realization is the output of an accumulator, ACC__2ND, at cycle time x. The value of ACC__2ND is updated every cycle until it is larger than the optimum Compromised Quality, QC_LUT. The cycle time x at such moment is determined as the mapping index $X_C$.

Figure 4:
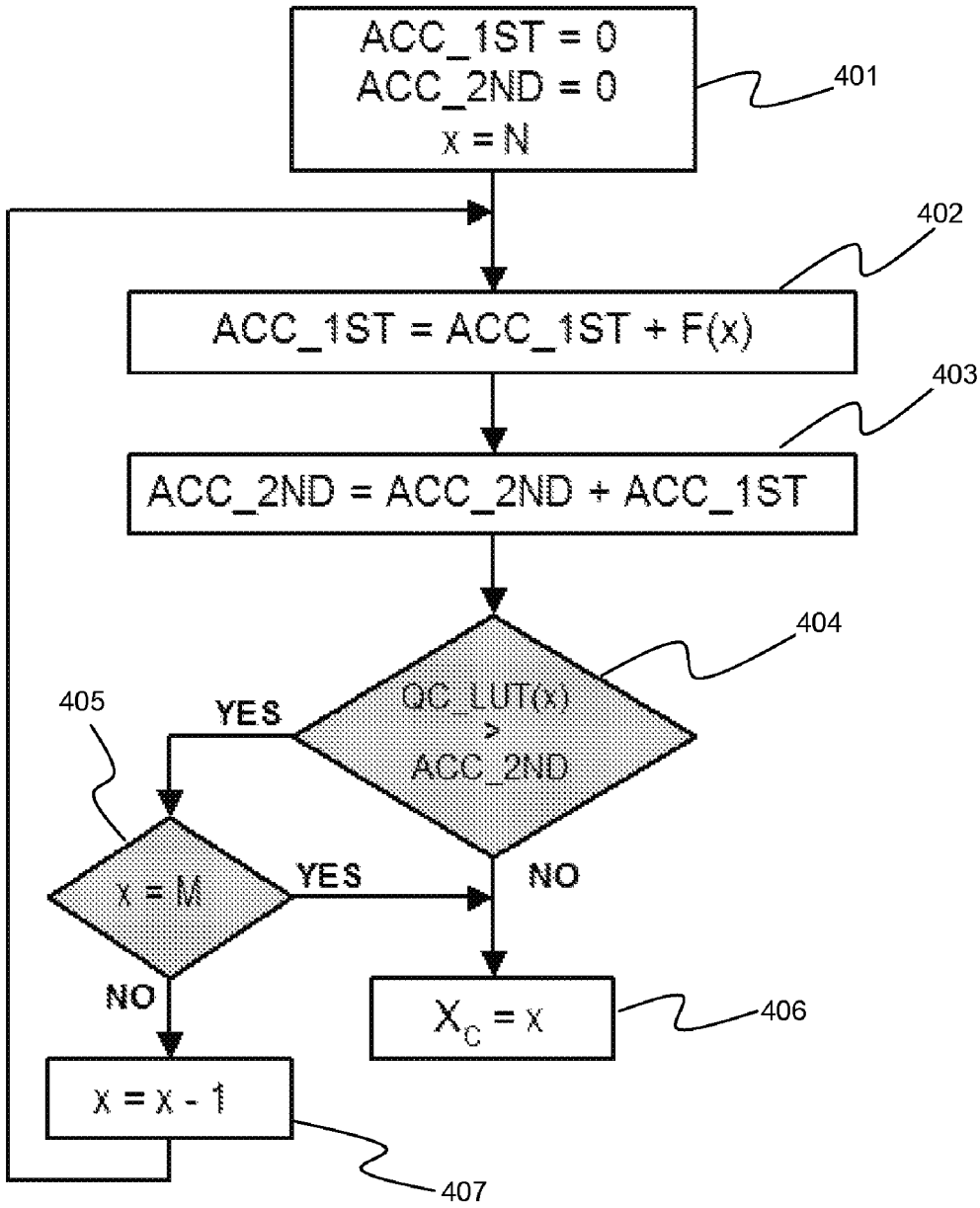
FIG. 4 is a flow chart for determining the optimum $X_C$ as the mapping index according to an embodiment of the presently claimed invention.

FIG. 4 is a flow chart that illustrates the method of solving the above inequality of equation (5) and finding the mapping index according to an embodiment of the invention. The method starts at initialization step 401, both accumulators ACC__1ST and ACC__2ND are initiated as zero, and x is set equal to N, the maximum intensity level. At updating first accumulator step 402, F(x), the distribution of pixel with value of x is added to the first accumulator ACC__1ST. At updating second accumulator step 403, the value of the first accumulator ACC__1ST is added to the second accumulator ACC__2ND.

At comparing step 404, the value of QC_LUT(x) is read from a look up table corresponding to the value x. Processing continues at decision step 405 if the optimum Compromised Quality QC_LUT(x) is found to be greater than the second accumulator ACC__2ND. Otherwise, processing ends at determining step 406 where x is determined as the mapping index $X_C$.

At decision step 405, the value of x is compared to the minimum value clipping value M. If x is as small as M, then processes ends at determining step 406, such that $X_C$ would have the value of x, i.e.: M. Otherwise, processing continues at decrement step 407.

At decrement step 407, x is deducted by 1 and processing returns to update first accumulator step 402 such that the values of accumulators are updated.

The flow chart shows that the actual hardware can be implemented with four units:

(a) a controller, such as a state machine or a microcontroller, that controls the flow, (b) a first accumulator that calculates $$\sum_{i=x}^{N} F(i),$$

(c) a second accumulator that calculates $$\sum_{i=x+1}^{N} (i-x)\cdot F(i)$$

(d) a Look Up Table that can be implemented by combinational logic or ROM

Advanced Approach with a Non-Linear Gamma Curve

According to a further embodiment of the presently claimed invention, non-linear luminance model is considered instead of the simplified tone mapping model, for example, to cater the gamma, γ, of an LCD, we have to look into the gamma factor equation, $$L(x) = BL_{MAX}\cdot\left(\frac{x}{N}\right)^{\gamma}$$

where L is the luminance and $BL_{MAX}$ is maximum backlight brightness.

Assuming that the backlight has been changed from $BL_{MAX}$ to $BL_{DIM}$ and we need to find a tone mapped x such that the final output luminance is the same (referred as x"). That is, $$L'(x') = BL_{DIM}\cdot\left(\frac{x'}{N}\right)^{\gamma} \text{ and } L(x) = L'(x').$$

Hence, $$BL_{DIM}\cdot\left(\frac{x'}{N}\right)^{\gamma} = BL_{MAX}\cdot\left(\frac{x}{N}\right)^{\gamma}$$

Rearranging, we have $$\frac{x'}{x} = \left(\frac{BL_{MAX}}{BL_{DIM}}\right)^{1/\gamma}$$

As can be seen from FIG. 1, x'/x is the slope of the tone mapping curve. Hence, $$\frac{N}{X_C} = \left(\frac{BL_{MAX}}{BL_{DIM}}\right)^{1/\gamma}$$

Since the dimmed backlight, $BL_{DIM}$, over the full backlight, $BL_{MAX}$, is the dimming factor, D. We have $$\frac{N}{X_C} = \left(\frac{1}{D}\right)^{1/\gamma} \text{ or } D = \left(\frac{X_C}{N}\right)^{\gamma}$$

Accordingly, equation (1) for determining Compromised Quality is changed to, $$\begin{aligned} Q_C &= \sum_{i=X_C+1}^{N} \text{Error}(i)^{\gamma}\cdot F(i) \\ &= \sum_{i=X_C+1}^{N} \text{Slope}^{\gamma}\cdot(\text{distance from } X_C)^{\gamma}\cdot F(i) \\ &= \sum_{i=X_C+1}^{N} \left(\frac{N}{X_C}\right)^{\gamma}\cdot(i-X_C)^{\gamma}\cdot F(i) \end{aligned}$$

to account for the non-linear luminance.

Meanwhile, equation (3) is updated based on the non-linear luminance model as:

$$\begin{aligned} Q_C &= \sum_{i=X_C+1}^{N} (\text{distance from } X_C)^{\gamma}\cdot F(i) \\ &= \sum_{i=X_C+1}^{N} (i-X_C)^{\gamma}\cdot F(i) \end{aligned}$$

The foregoing description of embodiments of the present invention are not exhaustive and any update or modifications to them are obvious to those skilled in the art, and therefore reference is made to the appending claims for determining the scope of the present invention.

The invention claimed is:

1. A method of adjusting image intensity to compensate backlight dimming in dynamic backlight control, comprising the steps of:

estimating distortion of an image that corresponds to different mapping index values ($X_C$) selected from intensity levels of said image, wherein said estimating distortion of said image is based on factors including:

the quantity of pixels that have intensity exceeding said mapping index value; and the amount that the intensity of each said pixel exceeds the corresponding mapping index value; and selecting from a plurality of schemes for adjusting image intensity to minimize overall resulting distortion, wherein said plurality of schemes are based on the minimum mapping index value corresponding to a maximum compromised quality value ($Q_{C_MAX}$) of said image for an application, the minimum of mapping index value being determined by computing distortion corresponding to mapping index values according to $$\sum_{i=X_c}^{N} (i-X_c)^{\gamma} F(i),$$

and finding the minimum mapping index value according to $$Q_{C_MAX} \geq \left(\frac{N}{X_c}\right)^{\gamma} \cdot \sum_{i=Xc}^{N} (i - X_c)^{\gamma} F(i),$$

where γ is the gamma factor of a display for displaying the image, F(i) is the pixel value distribution function of the image to be displayed, and N is the number of intensity levels.

2. The method of adjusting image intensity according to claim 1, wherein said step of selecting schemes further comprises the step of choosing an optimum mapping curve from a set of mapping curves corresponding to different mapping index values where said optimum mapping curve corresponding to said minimum mapping index value for converting the intensity of each pixel in said image.

3. The method of adjusting image intensity according to claim 2, wherein said set of mapping curves when plotted on a Cartesian plane with input pixel intensity as X-axis and output pixel intensity as Y-axis, have an initial slope of $N/X_C$, where N is the number of intensity levels for the image; and $X_c$ is the corresponding mapping index value.

4. The method of adjusting image intensity according to claim 3, wherein said mapping curves are non-linear curves.

5. An apparatus for adjusting image intensity to compensate backlight dimming in dynamic backlight control, comprising:

a processing unit for estimating distortion of an image that corresponds to different mapping index values ($X_C$) selected from the intensity levels of an image, wherein said estimated distortion of image is based on factors including:

the quantity of pixels that have intensity exceeding said mapping index value; and the amount that the intensity of each said pixel exceeds the corresponding mapping index value; and a look up table for selecting from a plurality of schemes for adjusting image intensity to minimize the distortion estimated by said processing unit, based on finding of the minimum mapping index value that corresponds to a maximum compromised quality value ($Q_{C_MAX}$) of said image for an application;

wherein said processing unit is configured with:

a first accumulator configured to calculate $$\sum_{i=Xc}^{N} F(i);$$

a second accumulator configured to calculate $$\sum_{i=Xc}^{N} (i - X_c)^{\gamma} F(i); \text{ and}$$

a logic controller with a state machine configured to find said minimum mapping index value according to $$Q_{C_MAX} \geq \left(\frac{N}{X_c}\right)^{\gamma} \cdot \sum_{i=X_c}^{N} (i - X_c)^{\gamma} F(i);$$

where γ is the gamma factor of a display for displaying the image, F(i) is the pixel value distribution function of the image to be displayed, and N is the number of intensity levels.

* * * * *